US006998724B2

(12) United States Patent
Johansen et al.

(10) Patent No.: US 6,998,724 B2
(45) Date of Patent: Feb. 14, 2006

(54) POWER GENERATION SYSTEM

(75) Inventors: John A. Johansen, Kongsberg (NO); Vidar Sten Halvorsen, Kongsberg (NO); Lars Fretland, Kongsberg (NO); Andreas Mohr, Drammen (NO); Christina M. Johansen, Kongsberg (NO); Veronique Prevault, Kongsberg (NO)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 10/780,999

(22) Filed: Feb. 18, 2004

(65) Prior Publication Data

US 2005/0179263 A1 Aug. 18, 2005

(51) Int. Cl.
*E21B 34/14* (2006.01)

(52) U.S. Cl. ..... 290/1 R; 166/65.1

(58) Field of Classification Search ..... 290/1 R; 166/65.1; 299/17; 175/40
See application file for complete search history.

(56) References Cited

U.S. PATENT DOCUMENTS 3,373,806 A * 3/1968 Stone ..... 166/356
3,789,355 A * 1/1974 Patton ..... 367/137
3,822,589 A * 7/1974 Le Peuvedic et al. ... 73/152.47
3,901,331 A * 8/1975 Djurovic ..... 175/171
3,968,473 A * 7/1976 Patton et al. ..... 367/83
4,013,945 A * 3/1977 Grosso ..... 324/207.25
4,240,463 A 12/1980 Moore ..... 137/492.5
4,415,823 A * 11/1983 Jurgens ..... 310/87
4,698,794 A * 10/1987 Kruger et al. ..... 367/83
4,920,811 A 5/1990 Hopper ..... 74/2
5,195,721 A 3/1993 Akkerman ..... 251/129.13
5,257,549 A 11/1993 Mole ..... 73/862.392
5,497,672 A 3/1996 Appleford et al. ..... 74/424.8
5,517,464 A * 5/1996 Lerner et al. ..... 367/84
5,519,295 A 5/1996 Jatnieks ..... 318/453
5,587,707 A * 12/1996 Dickie et al. ..... 340/870.09
5,626,200 A * 5/1997 Gilbert et al. ..... 175/40
5,839,508 A * 11/1998 Tubel et al. ..... 166/65.1
5,984,260 A 11/1999 Rawson et al. ..... 251/71
6,202,753 B1 3/2001 Baugh ..... 166/364
6,250,199 B1 6/2001 Schulte et al. ..... 91/4 R
6,269,874 B1 8/2001 Rawson et al. ..... 166/53
6,431,285 B1 * 8/2002 Hopper et al. ..... 166/368
6,460,936 B1 * 10/2002 Abramov et al. ..... 299/17
6,595,487 B1 7/2003 Johansen et al. ..... 251/129.04
6,702,025 B1 3/2004 Meaders ..... 166/335
6,729,130 B1 5/2004 Lilleland ..... 60/413
2003/0170077 A1 * 9/2003 Herd et al. ..... 405/224.2
2003/0230190 A1 12/2003 Douglas ..... 91/454

FOREIGN PATENT DOCUMENTS

EP 0 984 133 A1 3/2000

(Continued)

*Primary Examiner*—Joseph Waks
(74) *Attorney, Agent, or Firm*—Williams, Morgan & Amerson, P.C.

(57) ABSTRACT

A system for generating an electrical power output from a subsea installation that includes at least one flowline, wherein the system includes a turbine that is operatively connected to the flowline, the turbine being rotatable by fluid flowing through the flowline, and the turbine generating the electrical power output when the turbine is rotated.

57 Claims, 4 Drawing Sheets

FOREIGN PATENT DOCUMENTS

| | | | | |
|---|---|---|---|---|
| EP | 1106777 | A1 | * | 6/2001 |
| EP | 1 209 294 | A2 | | 5/2002 |
| EP | 1 241 322 | A1 | | 9/2002 |
| GB | 2 216 570 | A | | 10/1989 |
| GB | 2266546 | A | * | 11/1993 |
| GB | 2290320 | A | * | 12/1995 |
| NO | 309737 | B1 | | 9/1999 |
| WO | WO 95/08715 | | | 3/1995 |
| WO | WO 9939080 | A1 | * | 8/1999 |
| WO | WO 01/12950 | A1 | | 2/2001 |

* cited by examiner

POWER GENERATION SYSTEM

BACKGROUND OF THE INVENTION

1. Field of the Invention

The present invention generally relates to a system for generating electrical power. More specifically, in one illustrative example, the invention relates to a local electrical power source for an autonomous subsea installation such as a Christmas tree.

2. Description of the Related Art

The production from a subsea well is controlled by a number of valves that are assembled into a unitary structure generally referred to as a Christmas tree. The actuation of the valves is normally dependent upon hydraulic fluid to power hydraulic actuators that operate the valves. Hydraulic fluid is normally supplied through an umbilical running from a remote station located on a vessel or platform at the surface. Less commonly, the hydraulic umbilical may be run from a land-based station. Usually the actuators are controlled by pilot valves housed in a control module located at or near the subsea installation. The pilot valves direct the supply of fluid to each actuator, as required for each particular operation. The pilot valves may be electrically actuated, such as by solenoids. Such a system is commonly referred to as an electro-hydraulic system.

In addition to the above described flow control valves, actuators, and pilot valves, a number of sensors and detectors are commonly employed in subsea systems to monitor the state of the system and the flow of hydrocarbons from the well. Often a number of sensors, detectors and/or actuators are also located down hole. All these devices are controlled and/or monitored by a dedicated control system, which is usually housed in the control module.

The design of actuators and valves for subsea wells are dictated by stringent safety and reliability standards, because of the danger of uncontrolled release of hydrocarbons. A common requirement is that the valves must be "failsafe close". In other words, the valves must automatically close upon a loss of power or control, including a failure or malfunction of either the electrical or hydraulic systems. A typical method for providing a failsafe close capability is the use of one or more mechanical springs, which bias the actuator towards the closed position. The hydraulic pressure used to open the valve also holds the springs in the compressed state. Upon a loss of hydraulic pressure, either intentional or due to a system failure, the energy stored in the springs will be released, thus closing the valve. The force required to close a hydraulically actuated valve is dependent upon both the pressure of the fluid controlled by the valve (i.e., the formation pressure), and the ambient pressure (the hydrostatic water pressure for subsea installations) to which the hydraulic actuator is exposed. Higher formation and/or ambient pressures result in larger closing forces, and thus require larger springs.

In many countries there is a requirement for a downhole safety valve (Surface Controlled Subsurface Safety Valve, SCSSV) as an additional safety device for closing the flow path in the well tubing. Because this valve is located in the production flow, it must be operated by hydraulic fluid that is at a higher pressure than the fluid used to actuate the Christmas tree valves. Thus, there is a requirement for an additional system for supplying high-pressure hydraulic fluid to the subsea installation.

In order to control a subsea well, a connection must be established between the well and a monitoring and control station. The monitoring and control station may be located in a platform or floating vessel near the subsea installation, or alternatively in a more remote land station. The connection between the control station and the subsea installation is usually established by installing an umbilical between the two points. The umbilical may include hydraulic lines for supplying hydraulic fluid to the various hydraulic actuators located on or near the well. The umbilical may also include electrical lines for supplying electric power and also for communicating control signals to and/or from the various monitoring and control devices located on or near the well. The typical umbilical is a very complicated and expensive item. The umbilical can cost several thousand U.S. dollars per meter of length, and may be thousands of meters long.

For many years, electric valve actuators have been preferred in land based industries, because electric actuators are more compact than hydraulic actuators. Furthermore, most of the components of a typical electric actuator, such as the electric motor and/or gearbox, are readily available items that can be easily and inexpensively procured from many manufacturers. In some applications, electric actuators are seen as a good alternative to hydraulic actuators because the ambient pressure does not affect the required operating force of an electrically operated valve. Many proposals have been made to use electrically operated actuators instead of hydraulic actuators for subsea deployed valves. Examples of such devices are disclosed in U.S. Pat. Nos. 5,497,672 and 5,984,260. However, because each of these devices incorporates mechanical springs as a failsafe device, these actuators tend to be just as large and bulky as the hydraulic actuators they are intended to replace.

Typically, existing subsea electric actuators are powered from a remote location through a subsea cable, in order to ensure a sufficient and reliable supply of electric power. It is usually required that the power supply be sufficient to operate all the valves simultaneously. In U.S. Pat. Nos. 5,257,549 and 6,595,487 it has been proposed to provide a subsea battery power supply, but only to provide enough emergency power to close a single valve. It has also been proposed to operate a valve in a subsea environment using power generated locally by a thermoelectric device. However, such devices can provide only a limited amount of power, which would not be sufficient to operate all the valves in a larger installation. However, batteries have recently been developed which can store enough power to operate all valves in a subsea installation simultaneously, thus paving the way for solutions where power for the electric motors is stored in locally installed batteries.

Since such a system would have ample locally stored power to close all the valves, the bulky failsafe springs could be eliminated from the actuators. An added advantage is that the operation of such actuators will be independent of the water depth of the system. The need for pilot valves will also be eliminated, since the actuators may be directly controlled electrically. Thus, there will also be potentially large savings on umbilical cost since the hydraulic lines can be removed.

All-electric subsea systems require a more sophisticated control system than electro-hydraulic systems. The control system must control the charging of the batteries and monitor their status. The control system should also monitor the status and position of each valve so that at any time an operator can access this information and intervene if necessary. Furthermore, the control system must implement the failsafe function and close all valves if required.

Under certain circumstances and in certain locations a downhole safety valve (SCSSV) may be required. As discussed above, the low-pressure hydraulic line can be eliminated from the umbilical by using electric actuators for the flow control valves in the tree. In the case where an SCSSV is required, it would obviously be desirable to eliminate the high-pressure line from the umbilical as well. While downhole electric actuators for SCSSV's have been proposed, the hostile downhole environment would render such electric systems unreliable. One possible solution to this dilemma is to provide a local source of high-pressure hydraulic fluid at the subsea well. In this way, a typical hydraulic SCSSV actuator may still be provided downhole, without requiring a hydraulic umbilical to the surface. The local source of high-pressure fluid may be provided by an electrically powered pump or a pressure intensifier, which pressurizes a local reservoir of hydraulic fluid. An accumulator may also be provided for storing the high-pressure fluid.

In a water injection well, which is used to inject water or gas into the formation to assist in maintaining the pressure in the producing wells, the SCSSV be a simple spring-biased flapper valve, which is kept open by the injection flow itself. This arrangement eliminates the need for an SCSSV actuator altogether.

The present invention is directed to an apparatus for solving, or at least reducing the effects of, some or all of the aforementioned problems.

SUMMARY OF THE INVENTION

In general, the present invention is directed to an electrical power generation system, and various methods of operating same. In one exemplary embodiment the invention comprises a control system for an autonomous subsea installation. The subsea installation may include one or more electrically operated components, such as electric actuators for controlling one or more valves, and at least one flowline. In one embodiment, a system for generating an electric power output locally at the subsea installation is also provided. The power generation system comprises a turbine which is positioned in the flowline, such that fluid flowing through the flowline rotates the turbine to generate electrical power. In some embodiments, the turbine may be positioned in a bypass loop, so that fluid can be selectively directed through the turbine as required. One or more electrical power storage devices, such as batteries, are also provided for local power storage, wherein the power stored in the batteries is sufficient to power the electric actuators or to charge one or more batteries, the power from which may then be used to power the actuators. A control module for controlling the operation of the actuators, turbine, and batteries may also be provided, as well as an acoustic communication unit for communicating with the control module from a remote location such as a surface vessel or platform. By using only electric actuators, by generating and storing power locally, and by communication acoustically, the umbilical may be eliminated entirely, in order to realize great cost savings.

Each electric actuator comprises an electric motor. Locally placed batteries provide direct power to the electric actuators to open and close the valves. The batteries are charged from the turbine as needed. The control module monitors the state of the batteries and sends a signal to engage the turbine whenever the charge of any battery falls below a predetermined level. The control system includes an acoustic transmitter and an acoustic receiver for communication with a control station at a remote location. The control station may be located anywhere in the world. For example, the acoustic transmitter and acoustic receiver could communicate with a buoy at the surface, which buoy is then linked to a communications satellite.

Thus, in one exemplary embodiment, the invention comprises a wholly autonomous subsea installation, which can operate indefinitely without human intervention. A control system is provided, which can monitor and control the well without external guidance, while allowing access to collected data and emergency intervention if necessary. Among other tasks, the control system is adapted to monitor the flow of fluid through the flowline, to ensure that the system is operating correctly. The all-electric control system according to this exemplary embodiment of the invention results in a subsea installation which is simpler and less expensive than existing installations. The invention is especially advantageous for injection wells, because these wells are very often are located remotely from other subsea installations in a particular field, and thusly would otherwise require separate, dedicated umbilicals.

BRIEF DESCRIPTION OF THE DRAWINGS

The invention may be understood by reference to the following description taken in conjunction with the accompanying drawings, in which like reference numerals identify like elements, and in which.

Figure 1:
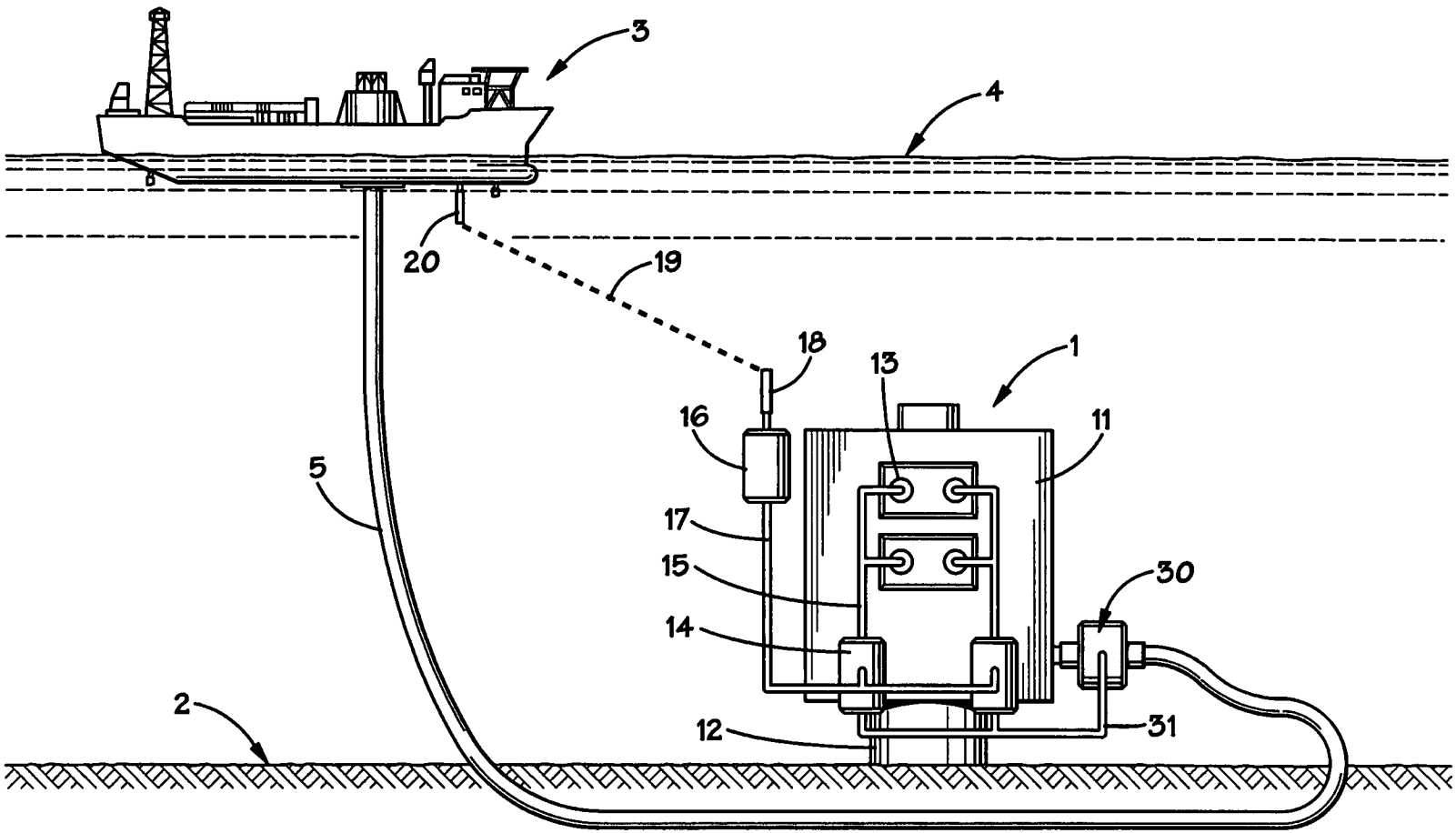
FIG. 1 shows an exemplary embodiment of the invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Referring to FIG. 1, in an exemplary embodiment of the invention a subsea installation 1 is located on the seabed 2. The installation 1 includes a Christmas tree 11 mounted on a wellhead 12, the wellhead being the uppermost part of a well that extends down into the sea floor to a subterranean hydrocarbon formation. The Christmas tree 11 has at least one electrically operated device such as electric actuator 13 for actuating at least one flow control valve (not shown). An electrically operated control module 14 is attached to the Christmas tree 11. The control module 14 houses electronic equipment for receiving and transmitting control and/or telemetry signals 19. The control module 14 also houses one or more electric power storage devices 22 (in FIG. 2), such as batteries, which provide power to the electric actuators and/or other electrical devices on the Christmas tree 11 or wellhead 12. A cable 15 extends from the control module 14 to actuator 13. Other equipment, such as various electrically operated sensors, may also be connected to the control module 14. The Christmas tree 11 may also include a remotely operated vehicle (ROV) panel (not shown) to allow manual actuation of the valves by an ROV, as is well known in the art. A vessel 3, such as a floating processing unit (FPU) is located on the surface 4 of the water. A flowline 5 extends from the vessel 3 to the Christmas tree 11. A local power generating system 30 is operatively connected to the flowline 5. A cable 31 connects the generating system 30 with the control module 14.

A hydro-acoustic communication unit 16 is attached to the Christmas tree 11 and is connected to the control module 14 via cable 17. The communication unit 16 includes a first antenna 18, an acoustic transmitter (not shown), and an acoustic receiver (not shown). The vessel 3 further includes a second antenna 20 for receiving and transmitting acoustic control and telemetry signals 19 to and from the antenna 18 on the Christmas tree 11. In other embodiments, different communication methods may be employed, such as radio waves. In other embodiments the antenna 18 may be deployed on a buoy (not shown) floating on the surface 4. The buoy could then be linked to a remote station via a satellite link, cable, radio, or other suitable communication means.

In the instant exemplary embodiment, the Christmas tree 11 is a water injection tree. Water is pumped from the vessel 3, through flowline 5, and to the subsea installation 1 where it is injected into the formation. Alternatively, the flowline 5 may extend from a processing or separation unit (not shown) located remotely from the well. The processing or separation unit processes the fluid produced from other wells in the formation, and separates the produced water from the hydrocarbons. The processing or separation unit may be located subsea, on a vessel or platform, or on land.

Figure 2:
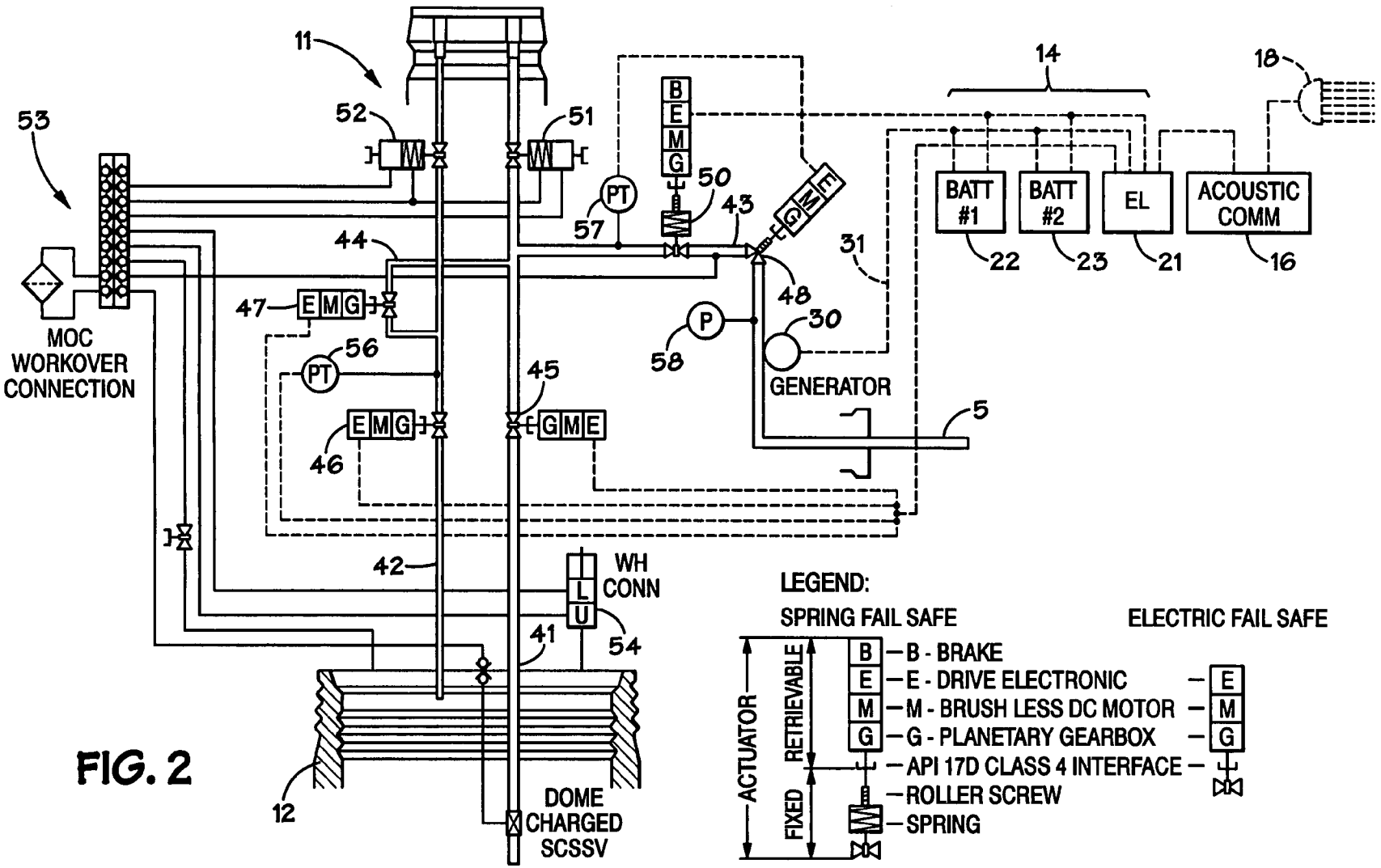
FIG. 2 shows a schematic of a subsea installation according an exemplary embodiment of the invention.

FIG. 2 shows a schematic of the Christmas tree 11 connected to the wellhead 12. The subsea well is completed in the usual manner by first drilling a hole and installing a conductor pipe, then installing a wellhead and a series of concentric casing strings anchored in the wellhead. Lastly the tubing string and tubing hanger are installed in the well and the Christmas tree 11 is connected to the wellhead 12. In FIG. 2, 41 denotes the production flow passage, which communicates with the flow bore of the production tubing string. 42 denotes the annulus passage, which communicates with the annular space between the tubing and the innermost casing string. 43 denotes the production outlet, from which produced fluids would normally exit in a producing well. In a water injection well, such as in the instant embodiment, the production outlet 43 is used to inject water into the well. The production outlet 42 is connected to flowline 5. The reference number 44 denotes a crossover passage, which links the annulus passage 42 and the production flow passage 41.

A master production valve 45 is located in the production flow passage 41, and a master annulus valve 46 is located in the annulus passage 42. A crossover valve 47 controls fluid flow through the crossover passage 44. A production wing valve 50 is located in the production outlet 43. A choke valve 48 controls the pressure in the production outlet 43. The power generating system 30 comprises a turbine 23, which is located in the flow path of production outlet 43, in a manner that is described more fully below.

Valves 45, 46, 47, 48 and 50 are each operated by an electric actuator. In one illustrative embodiment, each electric actuator (not shown) includes an electric motor, a gearbox, and a driveshaft, which is connected to its respective valve spindle via a standard API interface. In an exemplary embodiment, the electric motor may be a brushless type DC motor and the gearbox may be a planetary gearbox. Examples of a suitable motor 185 and gear box 175 combination include a Model Number TPM 050 sold by the German company Wittenstein. Each electric actuator has an associated motor controller (not shown) for receiving and sending signals from the control module 14 and modulating power to the motor upon receiving the appropriate commands from the control module 14. Each electric actuator is housed in a removable unit (not shown). The standard API interface makes it possible to remove the actuator in an emergency, and to actuate the valve spindle directly with an ROV or a diver.

Workover valves 51 and 52 are also located in the Christmas tree. These additional valves may be operated by hydraulic actuators (not shown), and are used for access to the well during workover situations. During workover an umbilical (not shown) will be used to supply hydraulic fluid to any remaining hydraulic actuators and to wellhead connector 53. The workover umbilical is connected to a workover unit 54 as shown.

A number of sensors are located in the subsea installation to monitor various parameters of the system. A pressure/temperature (PT) sensor 56 is located in the annulus passage 42. Another PT sensor 58 is located in the production outlet 43 upstream water injection flow of the choke 48. A third PT sensor 57 is located in the production outlet 43 downstream water injection flow of the choke. Sensors 57 and 58 are used to monitor the pressure of the injection fluid as it is pumped into the well. This information is used to regulate the choke 48 to achieve the desired injection pressure.

The control module 14 houses a processing unit 21, which includes electronics to receive and transmit signals to the various devices in the system, and to the hydro-acoustic antenna 18. The electronics in processing unit 21 also direct electric power as required to the various devices, including the electric valve actuators. The exemplary control module 14 also houses at least two batteries 22 for redundancy. The processing unit controls the operation of the electric actuators (not shown) and the turbine 23 (in FIG. 4), monitors the charge of the batteries 22 via a charge sensor (not shown), and handles communication signals both internally and externally of the system. An acoustic communication unit 16 includes the antenna 18, and provides communication with the receiving antenna 20 (in FIG. 1) at the surface vessel, platform, or remote station.

In other embodiments, the electric actuators (not shown) may be equipped with mechanical failsafe springs (not shown), to provide a failsafe closed capability. For example, referring to FIG. 2 the wing valve 50 is depicted with a failsafe spring. In the instant exemplary embodiment the failsafe springs are omitted from the other electric actuators. The processing unit 21 can be used, as long as electrical power is available, to provide failsafe closed functionality. Without electrical power the electric actuators will have a fail "as is" functionality.

Figure 4:
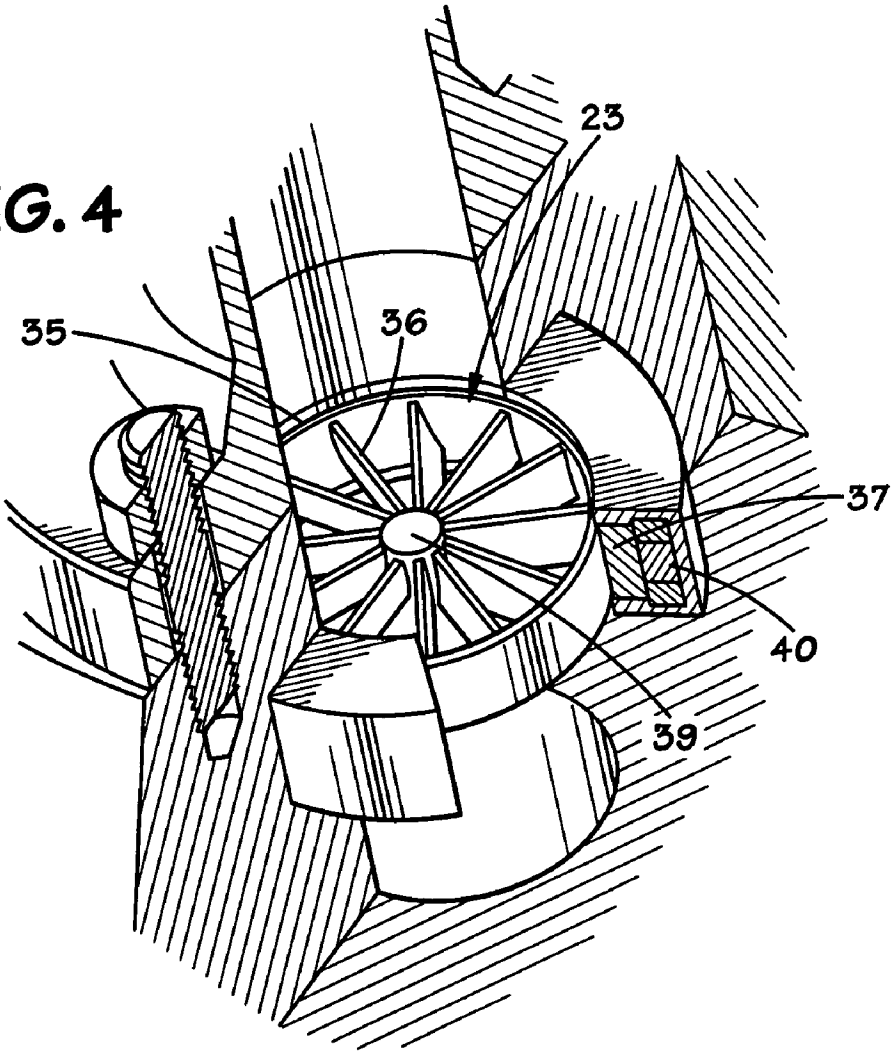
FIG. 4 shows a detailed view of an exemplary embodiment turbine.
Figure 3:
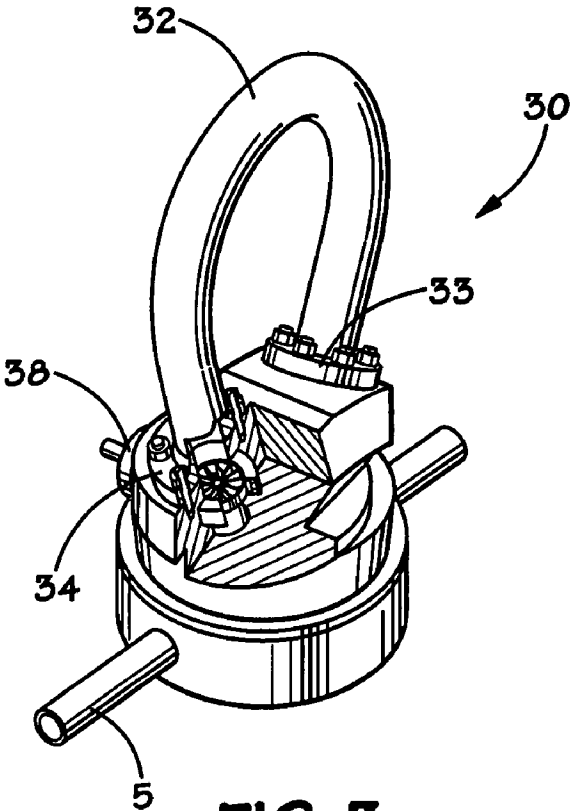
FIG. 3 shows an exemplary embodiment generator bypass loop.

Referring to FIGS. 3 and 4, the power generating system 30 includes a turbine 23 installed closed pipe loop 32, which is coupled to control valve 38 via flanges 33 and 34. The turbine 23 is operatively connected to flowline 5, and valve 38 regulates the flow of fluid from flowline 5 to the turbine 23. The valve 38 may be operated by an electric actuator (not shown), which may be controlled by the control module 14 (in FIG. 2). With this arrangement a controlled amount of fluid may be supplied through the pipe loop 32 as needed, to provide electricity to charge the batteries 22 (in FIG. 2). Valve 38 may be positioned in a first position such that fluid flowing through the flowline 5 is directed through the pipe loop 32. Valve 38 may also be positioned in a second position such that flow through flowline 5 bypasses the pipe loop 32 entirely.

The turbine 23 is shown in greater detail in FIG. 4. The turbine 23 includes a plurality of turbine blades 36 extending between a central shaft 39 and an outer ring 35. The blades 36 are distributed evenly around the shaft 39. The turbine 23 is rotated by the flow of fluid through pipe loop 32. A number of rotating permanent magnets 37 are mounted on the outer diameter of ring 35 to form rotor windings. Additional stationary permanent magnets 40 are fixedly mounted in a ring arrangement around the permanent magnets 37 to form stator windings. As is well known in the art, rotation of the rotor inside the stator will cause relative movement between the rotating and stationary magnets, thus creating a current and generating electric power. The windings in the stator are arranged to produce a three-phase AC power output or signal in a known manner.

The system includes sensors (not shown) for sensing the speed and direction of rotation of the turbine 23. Normally, voltage and current meters or sensors are also provided to enable calculation of generator output. The AC output can be expressed as three temporally offset sinusoidal curves or phases (A, B, and C). The time between the peaks of adjacent phases (e.g., A and B) determines the frequency and thereby the rotational speed of the turbine 23. A speed sensor is thus provided for sensing this frequency. The rotational direction of the turbine 23 can be determined from the sequence of the three phases. A change in the sequence of the phases (for example from ABC to BAC) will indicate a change in the direction of rotation of the turbine 23. A direction sensor is also provided for sensing the sequence of at least two of the three phases of the three-phase AC signal. The sensors for sensing the frequency and phase sequence of the power output may comprise calculation routines within the processing unit 21 of the control module 14.

During normal operations, the valve 38 may be positioned to allow flow through the turbine 23, with the turbine 23 running free or with a very small electrical load. In this configuration, the rotational speed and direction may be constantly monitored. From the rotational speed, the flowrate Q can be determined, thus allowing the detection of interruptions in the flow. When the turbine 23 is running under electrical load, the rotational speed may be compared to the current being produced by the generator. This enables the efficiency and/or performance of the turbine 23 to be monitored. Parameter measurements in a predetermined range may give an indication that the turbine 23 is failing and should be replaced. Another way to measure the performance of the turbine 23 is to measure the drop in rotational speed when the turbine 23 is placed under electrical load. For the particular turbine 23 used, the relationship between current output and the slowing of the turbine 23 under load will be known. If the slowing of the turbine 23 and/or the current output should deviate from this known relationship, it may be an indication that the turbine 23 is failing. Comparing the speed of the turbine 23 and the current generated will also give an indication of the efficiency of the turbine 23. A change in these readings over time may give an early warning of turbine 23 failure so that the turbine 23 can be replaced with a minimum of system downtime.

The measurement of rotational speed will also function as a flow meter during normal operations, since the flow rate is directly related to the number of revolutions per minute of the turbine 23. Such measurements may be compared with the flow rate measured at the pumping station, in order to determine if there are leaks any leaks present in the system.

When the turbine 23 is placed under electrical load, a pressure drop will be measured in pressure sensor 58. This pressure drop will be proportional to the power output according to the formula $P=\Delta p \times Q$ (where P is the power output, $\Delta p$ is the pressure drop, and Q is flow rate). This can be compared to the power output measured from the turbine 23, in order to give an indication of possible turbine 23 failure.

Figure 5:
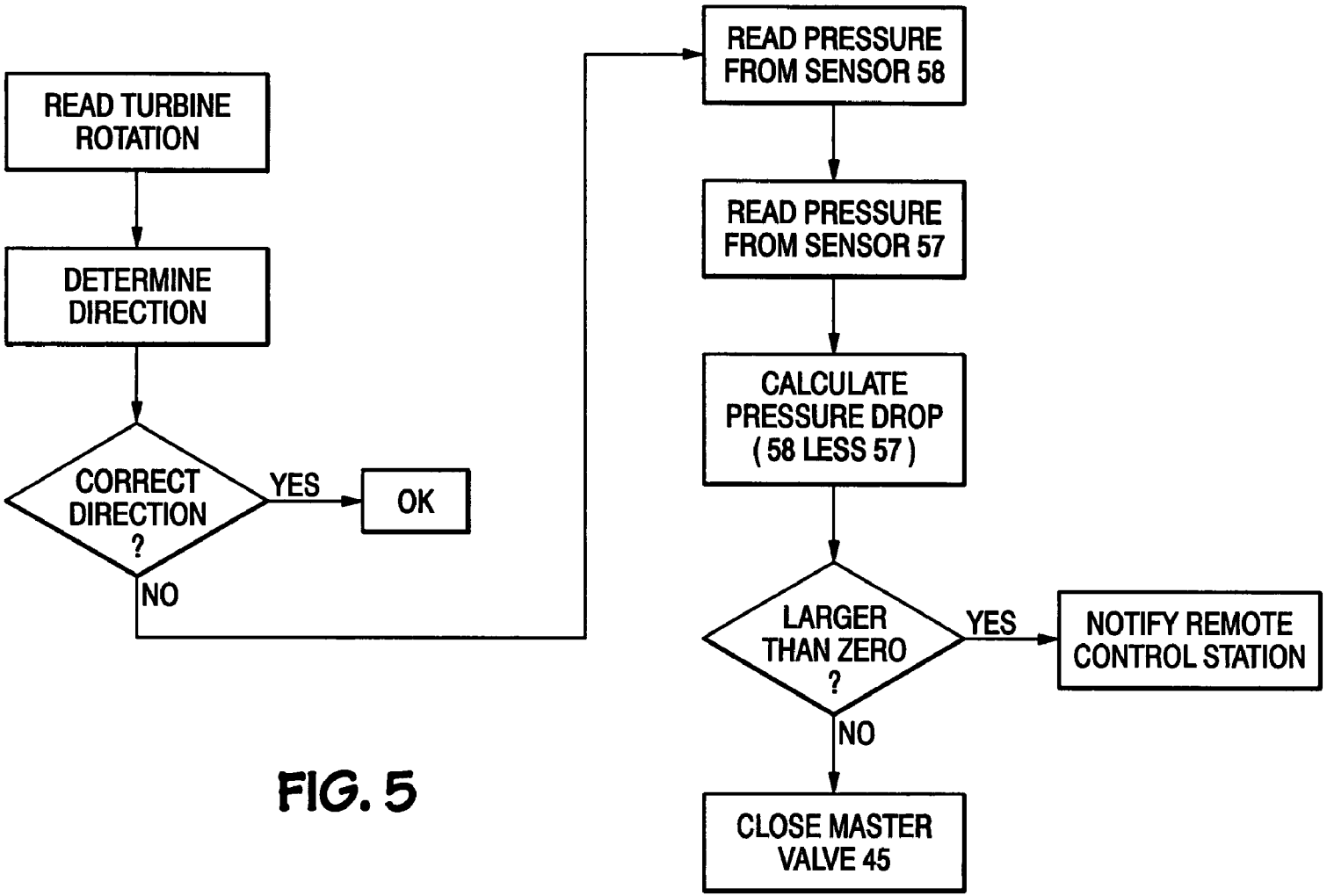
FIG. 5 shows an exemplary embodiment algorithm for monitoring the flow direction in the flowline and responding thereto.

In an injection well it is very important to sense the flow direction, since a reversal in flow direction indicates that the well may have become unstable and/or that water is flowing out of the well. When this occurs, the flow control valves (45 and 46) should be closed immediately to avoid problems with the well. An algorithm for accomplishing this is shown diagrammatically in FIG. 5. The flow direction can be measured in two ways. First, on the left hand side of FIG. 5 the direction of rotation of the turbine 23 is measured. A reversal of direction indicates that the flow is in the wrong direction and the master valve 45 should be closed. However, it is possible that this reading could be faulty, for example because of a fault in the turbine 23. To confirm that the flow direction has actually changed, the pressure drop across the choke is also measured, as shown on the right hand side of FIG. 5. If the pressure drop is positive across the choke, a faulty turbine 23 unit is indicated, and the remote control station is notified. If the pressure drop across the choke is negative, this confirms that fluid is flowing out of the well. In this case the master valve 45 should be closed automatically.

Referring again to FIG. 2, water is supplied through the flowline 5 to main passages 43 and 41. The master valve 45 and wing valve 50 are held in the open position, allowing water to be pumped down the well and into the formation. The control module 14 monitors the various parameters at the well, including the charge level on the batteries 22, and sends this information to a remote control station (not shown) on the vessel 3 (in FIG. 1) or on land. When the control module 14 senses that the charge level on the batteries 22 is below a first predetermined value, a signal is sent to engage (in an electrical sense) the turbine 23. In the engaged state, the turbine 23 generates electrical power. The electricity generated by the turbine 23 is sent through cable 31 to recharge the batteries 22. When the control system senses that the charge level on the batteries 22 is above a second predetermined value, a signal is sent to disengage the turbine 23, i.e., to remove the electrical load from the turbine 23, and the turbine 23 is allowed to return to its free-running state. In the electrically disengaged state, the turbine 23 generates little or no electrical power.

The downhole safety valve (not shown) may be a simple single-acting valve, for example a flapper valve. This type of valve will remain open as long as fluid is flowing into the well, but will close automatically when the fluid flow stops or reverses, thus closing off the well. In some countries there is a requirement to have a surface controlled subsurface safety valve (SCSSV). In this case a valve such as that described in Norwegian Patent Specification No. 313 209 can be used. Since this valve can be controlled from the outside of the Christmas tree, an electric actuator may be used. The safety control valve may also be manually closed, using an ROV if necessary.

Although the invention is described in conjunction with a water injection well, it should be understood that a similar system may be used for a producing well or a manifold system, without departing from the true spirit and scope of the invention. For example, the power generating system 30 could be operatively coupled to the production flowline of producing well, such that the flow of produced fluid causes the turbine 23 to rotate.

In general, the present invention is directed to an electrical power generation system, and various methods of operating same. In one illustrative embodiment, the system comprises at least one flowline, a turbine operatively connected to the flowline, the turbine being rotatable by fluid flowing through the flowline, and the turbine generating the electrical power output when the turbine is rotated.

In another illustrative embodiment, the system comprises a turbine operatively connected to the flowline, the turbine being rotatable by fluid flowing through the flowline, and the turbine generating the electrical power output when the turbine is rotated, at least one electrical power storage device, the electrical power output being supplied to the at least one electrical power storage device, at least one electrically operated component powered by the at least one electrical power storage device.

In one illustrative embodiment, the method comprises operatively connecting a turbine to the flowline and directing a flow of fluid through the turbine to thereby generate the electrical power output.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A system for generating an electrical power output from a subsea installation positioned adjacent a floor of a body of water and beneath a surface of said body of water, said subsea installation comprising at least one flowline, said system comprising a turbine positioned above said floor of said body of water and beneath said surface of said body of water, said turbine being operatively connected to said flowline, said turbine being rotatable by fluid flowing through said flowline, said turbine generating said electrical power output when said turbine is rotated, and at least one speed sensor for sensing a rotational speed of said turbine.

2. The system of claim 1, wherein said flowline is a production flowline.

3. The system of claim 1, wherein said flowline is an injection flowline.

4. The system of claim 1, further comprising at least one control valve for regulating a flow of said fluid to said turbine.

5. The system of claim 4, wherein said at least one control valve comprises at least a first position in which fluid flowing through said flowline is directed through said turbine, and a second position in which fluid flowing through said flowline bypasses said turbine.

6. The system of claim 1, wherein said electrical power output comprises an AC signal having a frequency which is proportional to said rotational speed of said turbine, and said at least one speed sensor comprises a frequency sensor for sensing said frequency.

7. The system of claim 6, further comprising:

at least one current sensor for sensing a current produced by said turbine;

a control unit for determining an efficiency of said turbine, said determination of said efficiency being based upon said rotational speed and said current.

8. The system of claim 1, further comprising a control module for determining a flow rate of fluid flowing through said turbine, said determination of said flow rate being based upon said rotational speed sensed by said speed sensor.

9. The system of claim 1, further comprising at least one direction sensor for sensing the direction of rotation of said turbine.

10. The system of claim 9, wherein said electrical power output comprises a three-phase AC signal, and said at least one direction sensor comprises a phase sequence sensor for sensing the sequence of at least two phases of said three-phase AC signal.

11. The system of claim 1, further comprising:

a choke valve connected to said flowline;

a first pressure sensor for sensing a first pressure in said flowline on one side of said choke valve; and a second pressure sensor for sensing a second pressure in said flowline on the other side of said choke valve.

12. The system of claim 11, further comprising a control module for determining a flow direction of fluid flowing through said choke, said determination of said flow direction being based upon said first and second pressures.

13. The system of claim 12, further comprising a master valve connected to said flowline, said control module controlling said master valve in response to said flow direction.

14. The system of claim 1, further comprising at least one electrically operated component, said electrical power output being supplied to said at least one electrically operated component.

15. The system of claim 14, wherein said at least one electrically operated component comprises a valve actuator.

16. The system of claim 14, wherein said at least one electrically operated component comprises a control module.

17. The system of claim 1, further comprising at least one electrical power storage device, said electrical power output being supplied to said at least one electrical power storage device.

18. The system of claim 17, wherein said at least one electrical power storage device comprises a battery.

19. The system of claim 17, further comprising at least one electrically operated component powered by said at least one electrical power storage device.

20. The system of claim 1, further comprising a control module for controlling said turbine.

21. The system of claim 20, wherein said control module causes said turbine to selectively be in at least a first state wherein said turbine generates electrical power, and a second state wherein said turbine does not generate electrical power.

22. The system of claim 21, further comprising:

at least one electrical power storage device, said electrical power output being supplied to said at least one electrical power storage device; and at least one charge sensor for sensing the charge level of said at least one electrical power storage device, said charge level determining the selection of said first and second states of said turbine by said control module.

23. The system of claim 1, wherein said turbine comprises:

a rotary member comprising a plurality of blades and at least one rotating magnet;

a fixed housing comprising at least one stationary magnet comprising stator windings, wherein rotation of said rotary member causes relative movement between said at least one rotating magnet and said at least one stationary magnet comprising said stator windings, said relative motion generating said electrical power output; and a communication unit for communicating with a control station located remotely from said subsea installation, wherein said communication unit comprises at least one acoustic transmitter.

24. The system of claim 23, wherein said communication unit comprises at least one acoustic receiver.

25. The system of claim 1, further comprising a closed flow loop in fluid communication with said flowline, said turbine being positioned in said closed flow loop.

26. The system of claim 25, further comprising at least one valve for regulating a flow of said fluid through said closed flow loop.

27. A system for generating an electrical power output to support a subsea installation positioned adjacent a floor of a body of water and beneath a surface of said body of water, said subsea installation comprising at least one flowline, said system comprising:

a turbine positioned above said floor of said body of water and beneath said surface of said body of water, said turbine being operatively connected to said flowline, said turbine being rotatable by fluid flowing through said flowline, and said turbine generating said electrical power output when said turbine is rotated;

at least one electrical power storage device, said electrical power output being supplied to said at least one electrical power storage device; and at least one electrically operated component powered by said at least one electrical power storage device, wherein said at least one electrically operated component comprises a valve actuator.

28. The system of claim 27, wherein said subsea installation further comprises a subsea Christmas tree.

29. The system of claim 27, further comprising a subsea control module for controlling said system.

30. The system of claim 29, wherein said control module causes said turbine to selectively be in at least a first state wherein said turbine generates electrical power, and a second state wherein said turbine does not generate electrical power.

31. The system of claim 30, further comprising at least one charge sensor for sensing the charge level of said at least one electrical power storage device, said charge level determining the selection of said first and second states of said turbine by said control module.

32. The system of claim 27, further comprising a closed flow loop in fluid communication with said flowline, said turbine being positioned in said closed flow loop.

33. The system of claim 32, wherein said closed flow loop is retrievable using an ROV.

34. A method for generating an electrical power output from a subsea installation positioned adjacent a floor of a body of water and beneath a surface of said body of water, said subsea installation comprising at least one flowline, said method comprising:

operatively connecting a turbine positioned above said floor of said body of water and beneath said surface of said body of water to said flowline;

directing a flow of fluid through said turbine to thereby generate said electrical power output; and sensing a rotational speed of said turbine.

35. The method of claim 34, further comprising:

sensing a current produced by said turbine; and determining an efficiency of said turbine, said determination of said efficiency being based upon said rotational speed and said current.

36. The method of claim 34, further comprising determining a flow rate of said fluid flowing through said turbine, said determination of said flow rate being based upon said rotational speed.

37. The method of claim 34, further comprising sensing a direction of rotation of said turbine.

38. The method of claim 34, further comprising:

connecting a choke valve to said flowline;

sensing a first pressure in said flowline on one side of said choke valve; and sensing a second pressure in said flowline on the other side of said choke valve.

39. The method of claim 38, further comprising determining a flow direction of fluid flowing through said choke valve, said determination of said flow direction being based upon said first and second pressures.

40. The method of claim 39, further comprising:

connecting a master valve to said flowline;

controlling said master valve in response to said flow direction.

41. The method of claim 34, further comprising supplying said electrical power output to at least one electrically operated device.

42. The method of claim 34, further comprising supplying said electrical power output to at least one electrical power storage device.

43. The method of claim 42, further comprising powering at least one electrically operated device with said at least one electrical power storage device.

44. The method of claim 42, further comprising:

sensing a charge level of said at least one electrical power storage device; and when said charge level is below a first predetermined value, causing said turbine to be in a first state wherein said turbine generates electrical power.

45. The method of claim 44, further comprising:

when said charge level is above a second predetermined value, causing said turbine to be in a second state wherein said turbine does not generate electrical power.

46. The method of claim 34, further comprising:

locating a control station remotely from said subsea installation; and communicating acoustically between said subsea installation and said control station.

47. A system for generating an electrical power output from a subsea installation positioned adjacent a floor of a body of water and beneath a surface of said body of water, said subsea installation comprising at least one flowline, said system comprising a turbine positioned above said floor of said body of water and beneath said surface of said body of water, said turbine being operatively connected to said flowline, said turbine being rotatable by fluid flowing through said flowline, said turbine generating said electrical power output when said turbine is rotated, and at least one direction sensor for sensing the direction of rotation of said turbine.

48. A system for generating an electrical power output from a subsea installation, said subsea installation comprising at least one flowline, said system comprising:

a turbine operatively connected to said flowline, said turbine being rotatable by fluid flowing through said flowline, said turbine generating said electrical power output when said turbine is rotated, a choke valve connected to said flowline;

a first pressure sensor for sensing a first pressure in said flowline on one side of said choke valve; and a second pressure sensor for sensing a second pressure in said flowline on the other side of said choke valve.

49. The system of claim 48, further comprising a control module for determining a flow direction of fluid flowing through said choke, said determination of said flow direction being based upon said first and second pressures.

50. The system of claim 48, further comprising a master valve connected to said flowline, said control module controlling said master valve in response to said flow direction.

51. A system for generating an electrical power output from a subsea installation positioned adjacent a floor of a body of water and beneath a surface of said body of water, said subsea installation comprising at least one flowline, said system comprising a turbine positioned above said floor of said body of water and beneath said surface of said body of water, said turbine being operatively connected to said flowline, said turbine being rotatable by fluid flowing through said flowline, said turbine generating said electrical power output when said turbine is rotated, and at least one electrically operated component, said electrical power output being supplied to said at least one electrically operated component, wherein said at least one electrically operated component comprises a valve actuator.

52. A system for generating an electrical power output to support a subsea installation, said subsea installation comprising at least one flowline, said system comprising:

a turbine operatively connected to said flowline, said turbine being rotatable by fluid flowing through said flowline, and said turbine generating said electrical power output when said turbine is rotated;

at least one electrical power storage device, said electrical power output being supplied to said at least one electrical power storage device;

at least one electrically operated component powered by said at least one electrical power storage device;

a subsea control module for controlling said system, wherein said control module causes said turbine to selectively be in at least a first state wherein said turbine generates electrical power, and a second state wherein said turbine does not generate electrical power; and at least one charge sensor for sensing the charge level of said at least one electrical power storage device, said charge level determining the selection of said first and second states of said turbine by said control module.

53. A subsea system for generating electrical power, said system being positioned in a body of water, said system comprising:

a subsea installation positioned adjacent a floor of said body of water, said subsea installation comprising at least one production flowline;

a turbine positioned above said floor of said body of water and below a surface of said body of water, said turbine being operatively coupled to said at least one production flowline, said turbine being rotatable by production fluid flowing through said production flowline, said turbine generating electrical power output when said turbine is rotated by said production fluid.

54. The system of claim 53, wherein said turbine is positioned on said subsea installation.

55. A subsea system for generating electrical power, said system being positioned in a body of water, said system comprising:

a subsea installation positioned adjacent a floor of said body of water, said subsea installation comprising at least one fluid injection flowline;

a turbine positioned above said floor of said body of water and below a surface of said body of water, said turbine being operatively coupled to said at least one fluid injection flowline, said turbine being rotatable by fluid flowing through said fluid injection flowline, said turbine generating electrical power output when said turbine is rotated by said fluid.

56. The system of claim 55, wherein said turbine is positioned on said subsea installation.

57. The system of claim 55, wherein said fluid injection flowline is a water injection flowline and said fluid flowing through said fluid injection flowline comprises water.

* * * * *